US005490460A

United States Patent [19]

Soble et al.

[11] Patent Number: 5,490,460

[45] Date of Patent: Feb. 13, 1996

[54] AUTOMATED CLEANING OF PRINTING CYLINDERS

[75] Inventors: Richard M. Soble, Highland Park; Timothy E. Owens, Downers Grove; Gregg E. Johnson, River Grove, all of Ill.

[73] Assignee: Graymills Corporation, Chicago, Ill.

[21] Appl. No.: 281,417

[22] Filed: Jul. 27, 1994

[51] Int. Cl.[6] ..... B41F 35/00

[52] U.S. Cl. ..... 101/424; 101/423

[58] Field of Search ..... 101/424, 423, 101/425, 424.1; 134/105, 137, 148, 149

[56] References Cited

U.S. PATENT DOCUMENTS

| | | | |
|---|---|---|---|
| 430,655 | 6/1890 | Kimball | 134/137 |
| 3,040,754 | 6/1962 | Lear | 134/149 |
| 4,498,934 | 2/1985 | Potts | 134/105 |
| 4,705,054 | 11/1987 | Fields | 134/184 |
| 5,000,206 | 3/1991 | Kramer et al. | 134/148 |
| 5,291,827 | 3/1994 | Liers et al. | 101/424 |
| 5,322,078 | 6/1994 | Tuttle | 134/105 |

*Primary Examiner*—Edgar S. Burr

*Assistant Examiner*—Anthony H. Nguyen

*Attorney, Agent, or Firm*—Marshall, O'Toole, Gerstein, Murray & Borun

[57] ABSTRACT

In order to facilitate the removal of ink and other material commonly used in flexography and rotogravure processes, an automated apparatus and method for cleaning a printing cylinder in a tank is disclosed. The tank is adapted to receive a printing cylinder that is to be cleaned of a dried ink on a surface thereof and a cleaning solution in an amount sufficient to substantially immerse the printing cylinder. It also includes a sprayer within the tank for spraying the surface of the printing cylinder with the cleaning solution and wheels within the tank for rotating the printing cylinder as the sprayer is spraying the surface thereof. The method includes the steps of providing a tank for receiving a printing cylinder that is to be cleaned and substantially immersing the printing cylinder in a cleaning solution within the tank. It also includes spraying a surface of the printing cylinder with the cleaning solution in the tank and rotating the printing cylinder as the surface of the printing cylinder is being sprayed. In addition to the foregoing, the automated cleaning may be facilitated by heating the cleaning solution, filtering the cleaning solution as it is cycled from a reservoir to the tank, and rinsing residue from the printing cylinder.

10 Claims, 4 Drawing Sheets

AUTOMATED CLEANING OF PRINTING CYLINDERS

FIELD OF THE INVENTION

The present invention generally is related to cleaning equipment which is designed to be useful in the printing industry and, more particularly, an automated apparatus and method used to clean ink or other material frown a printing cylinder, anilox roll, or the like.

BACKGROUND OF THE INVENTION

In the printing industry, there exist well-defined printing processes which are specifically known as flexography and rotogravure. These processes typically use liquid inks and coatings which differ from paste-type off-set printing ink in ways which create special problems. More specifically, these liquid inks are known to be fast drying and, when the ink is dried on the press parts, are most difficult to clean.

In recent years, this problem has become even more pronounced. The reason for the encountered difficulties lies in the trend toward the use of water-based inks. As is known, water-based inks are not resolvable and are almost impossible to remove once dried.

Despite this fact, it is critical to be able to remove these inks from the press parts for a singularly important reason. In particular, the expense of equipment utilized in the printing industry, and the quality nature of the printing process, makes it essential to be able to remove ink from the press parts that are used to transfer ink to the printing plate, i.e., anilox rolls and rubber rolls, and the printing cylinder, i.e., gravure cylinder. For this reason, Graymills Corporation has developed a proprietary chemical solution specifically designed for removing water-based inks.

While this represents a significant advancement in the field, there is still a great deal of difficulty involved in cleaning press parts. It has remained to provide an automated apparatus and method which can accomplish cleaning in a highly effective and efficient manner. For this purpose, the present invention is directed to overcoming the foregoing problems that have prevailed in the printing industry.

SUMMARY OF THE INVENTION

It is, therefore, an object of the present invention to provide an automated apparatus and method for cleaning a printing cylinder. It is a further object of the invention to provide such an apparatus and method where the printing cylinder or anilox roll is substantially immersed during the cleaning cycle. It is an additional object of the present invention to utilize a "spray-under-immersion" technique to achieve the cleaning.

Accordingly, it will be understood that the present invention is directed to an automated apparatus for cleaning a printing cylinder in a tank. The tank is adapted to receive a printing cylinder that is to be cleaned of a dried ink and other material on a surface thereof and a cleaning solution in an amount sufficient to substantially immerse the printing cylinder. The tank also includes means for spraying the surface of the printing cylinder with the cleaning solution and means for rotating the printing cylinder as the spraying means is spraying the surface thereof. With these features, the apparatus may also advantageously include means for storing, heating, filtering and recycling the cleaning solution.

In the exemplary embodiment, the means for recycling the cleaning solution includes a storage reservoir, a heater, a filter, and a pump. The heater is advantageously disposed in the storage reservoir for heating the cleaning solution therewithin, and there is also preferably a heater in the cleaning tank, and the pump delivers the cleaning solution from the storage reservoir to the tank after the cleaning solution has been heated where the other heater maintains the solution in a heated condition. Still additionally, the apparatus suitably includes drain means for returning the cleaning solution to the storage reservoir from the tank.

Preferably, the apparatus further includes means for rinsing the printing cylinder after the cleaning solution has been returned to the storage reservoir from the tank.

In a highly preferred embodiment, the spraying means includes a longitudinally extending spray manifold within the tank which has a plurality of spray nozzles, each directing a spray of the cleaning solution onto the surface of the printing cylinder. Further, the rotating means advantageously includes two sets of wheels or, alternatively, a pair of longitudinally extending rollers, in the tank with the wheels or rollers being spaced or capable of being spaced to handle different sized cylinders or rolls. Additionally, the rotating means advantageously includes means for driving at least one of the rollers or one or both of the wheels of a set of wheels to thereby impart rotation to the printing cylinder within the cleaning solution in the tank.

Still more specifically, the wheels or rollers preferably include one of the sets of wheels or rollers comprising a driven set of wheels or rollers and the other of the sets of wheels or rollers comprising an idler set of wheels or rollers adjustably positioned relative to the driven set of wheels or rollers.

In another respect, it will be understood that the present invention is directed to an automated method for cleaning a printing cylinder. The method includes the steps of providing a tank for receiving a printing cylinder that is to be cleaned, substantially immersing the printing cylinder in a cleaning solution within the tank, spraying a surface of the printing cylinder with the cleaning solution in the tank, and rotating the printing cylinder as the surface of the printing cylinder is being sprayed. Preferably, the method also includes the step of heating the cleaning solution before and during immersing and spraying of the printing cylinder.

Still additionally, the method advantageously includes the step of cycling the cleaning solution from a reservoir to the tank and then back into the reservoir. It may suitably include the further step of filtering the cleaning solution as it is cycled during the cycling step. Also, the method advantageously includes the step of rinsing the printing cylinder of residue after the cleaning solution has been cycled back into the reservoir.

Other objects, advantages and features of the present invention will become apparent from a consideration of the following specification taken in conjunction with the accompanying drawings.

DETAILED DESCRIPTION OF THE PREFERRED EMBODIMENT

Figure 1:
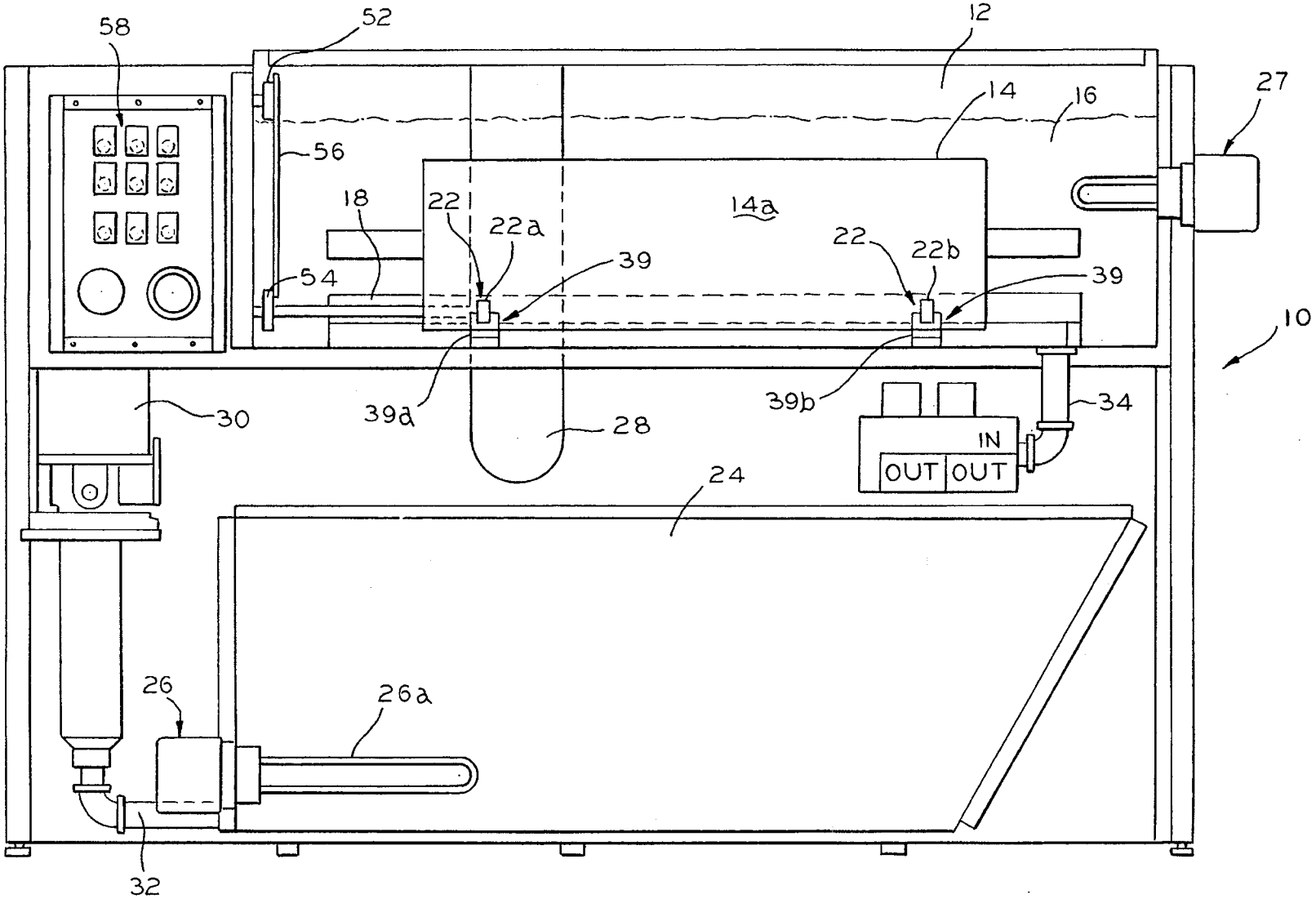
FIG. 1 is a front elevational view of an automated apparatus for cleaning a printing cylinder in accordance with the present invention.

In the illustrations given, and with reference first to FIG. 1, the reference numeral 10 designates generally an apparatus for cleaning a printing cylinder in accordance with the present invention. The apparatus 10 includes a tank 12 for receiving a printing cylinder 14 that is to be cleaned of a dried ink on a surface 14*a* thereof and a cleaning solution 16 for the tank 12 sufficient to substantially immerse the printing cylinder 14. The apparatus 10 also includes means for spraying the surface 14*a* of the printing cylinder 14 with the cleaning solution 16 in the tank 12 and means for rotating the printing cylinder 14 as the spraying means is spraying the surface 14*a* thereof. In this connection, and as described in greater detail hereinafter, the spraying means includes a spray manifold 18 (see FIG. 4) and the rotating means includes two sets of wheels 20 and 22 (see FIGS. 1 and 2).

Figure 2:
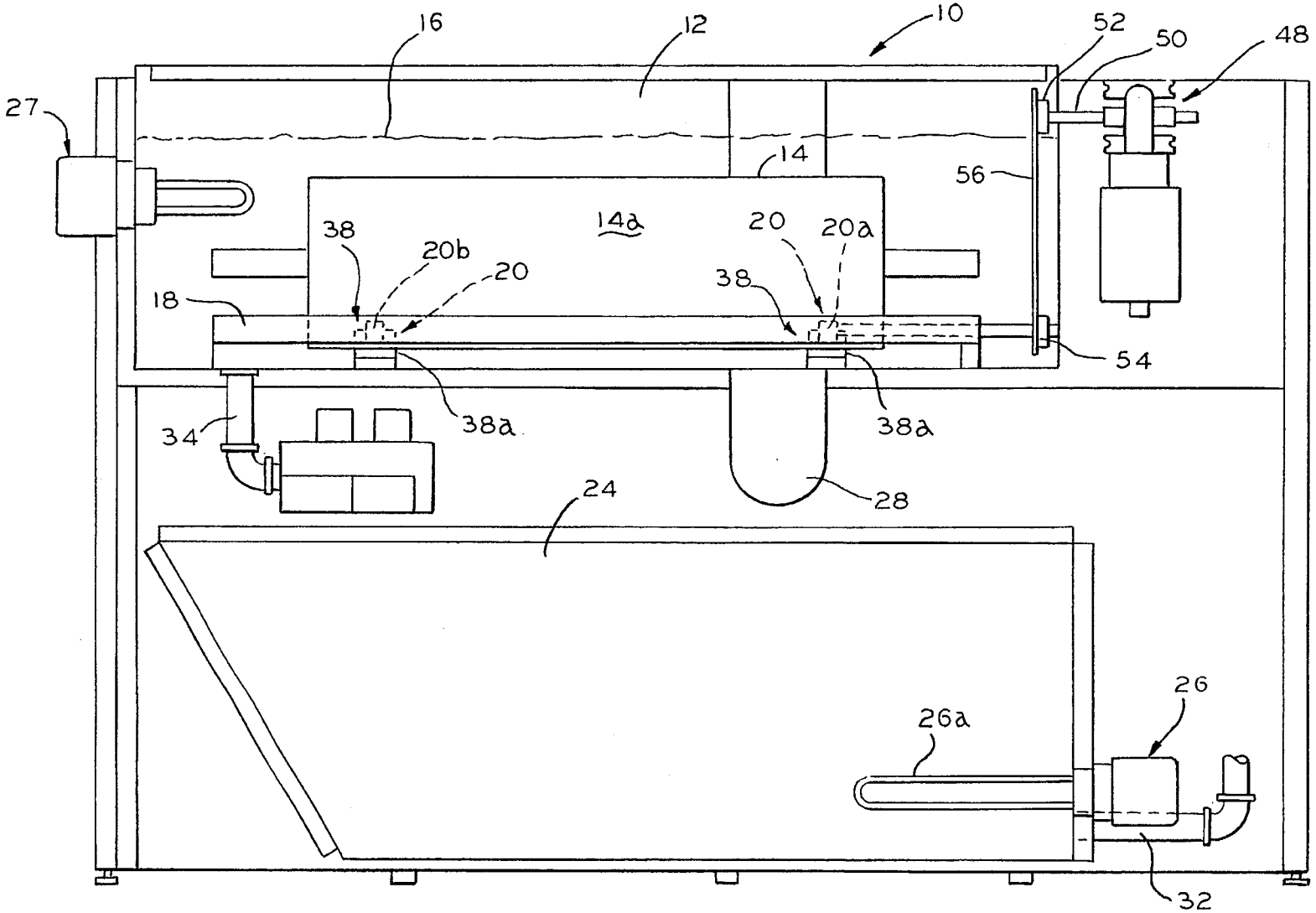
FIG. 2 is a is a rear elevational view of the apparatus illustrated in FIG. 1.
Figure 3:
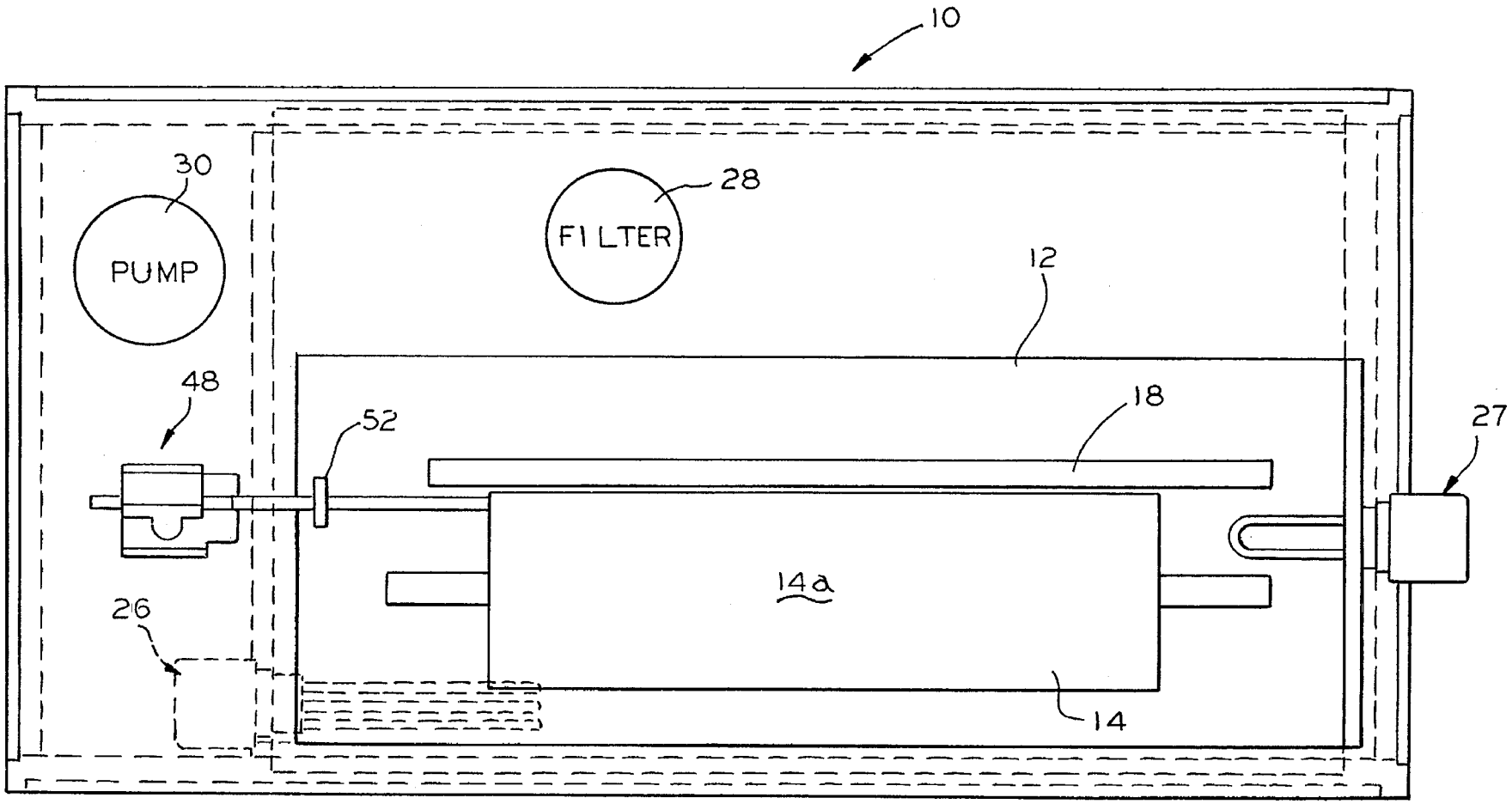
FIG. 3 is a is a top plan view of the apparatus illustrated in FIG. 1.

As best shown in FIGS. 1 and 2, the apparatus 10 includes means for storing the cleaning solution 16 which may take the form of a storage reservoir 24. It will also be seen that the apparatus 10 includes means for heating the cleaning solution 16 in the form of a heater 26 which is suitably disposed in the storage reservoir 24 and has a heating element generally designated 26*a*, and there is also preferably a heater 27 which is in the cleaning tank 12. Still additionally, the apparatus 10 will be understood to include means for filtering the cleaning solution 16 which may take the form of a filter 28 (see FIG. 3).

As will be appreciated, the apparatus 10 also has a pump 30 which receives cleaning solution 16 from the storage reservoir 24 through a pipe 32. The cleaning solution 16 is delivered by the pump 30 to the tank 12 after it has been heated by the heater 26 following which it may be maintained at temperature in the tank 12 by the heater 27. Collectively, the storage reservoir 24, the heater 26, the heater 27, the filter 28, and the pump 30 comprise means for recycling the cleaning solution 16.

Referring to FIG. 2, the apparatus 10 includes a drain 34 for returning the cleaning solution 16 to the storage reservoir 24 from the tank 12. It will also be seen that the apparatus 10 includes means for rinsing the printing cylinder 14 after the cleaning solution 16 has been returned to the storage reservoir 24 from the tank 12 by means of the drain 34. In this connection, the details of construction of the drain 34 and the means for rinsing the printing cylinder 14 will be set forth hereinafter.

Figure 4:
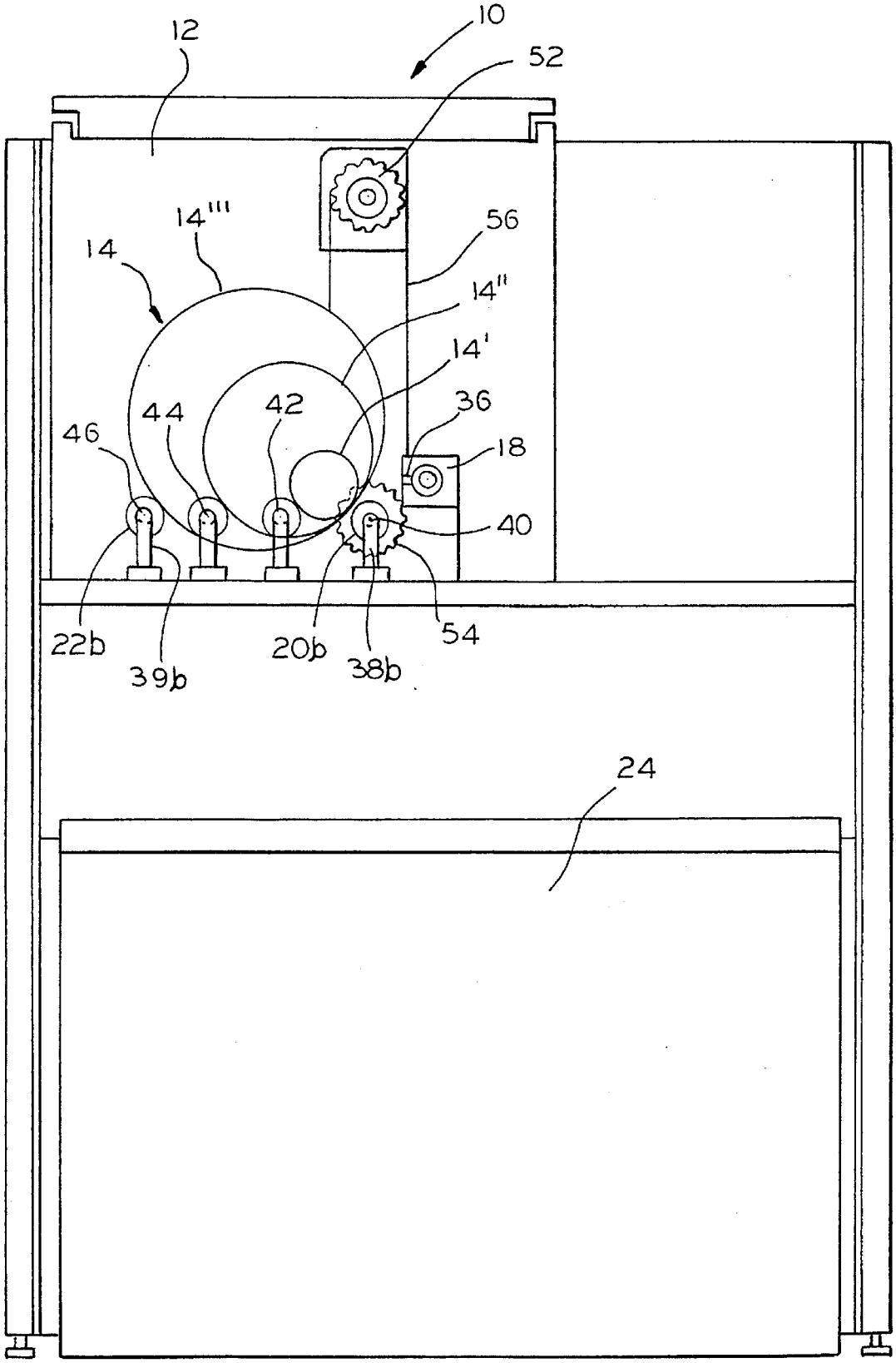
FIG. 4 is an end elevational view of an automated apparatus for cleaning a printing cylinder in accordance with the present invention.

Referring to FIGS. 2 and 4, the spray manifold 18 will be understood to extend longitudinally within the tank 12 and to have a plurality of spray nozzles, such as 36, each directing a spray of the cleaning solution 16 onto the surface 14*a* of the printing cylinder 14. It will also be noted that the two sets of wheels 20 and 22 support the printing cylinder 14 longitudinally within the tank 12 as well. In this connection, the two sets of wheels 20 and 22 are such that at least one of the wheels 20*a* of one set such as 20 is a driven wheel and the other of the sets of wheels 22 is an idler set which may be adjustably positioned relative to the set of wheels 20.

More specifically, and referring to FIG. 4, two pairs of wheel supports, such as 38 and 39, are preferably positioned as shown in longitudinally spaced relation in the bottom of the tank 12. The pairs of wheel supports 38 and 39 may, if desired, be made such that one of each pair such as 38*b* and 39*b* is longitudinally adjustable relative to the other of that pair such as 38*a* and 39*a*, and, in addition, they are such that at least the wheel support 38*a* is adapted to secure the driven wheel 20*a* of the set of wheels 20 in a fixed position both longitudinally and in a direction transverse to the longitudinal axis of the spray manifold 18 as at 40. Further, while the wheel support 38*b* may be longitudinally adjustable, the wheel 20*b* supported by it is not adjustable in a direction transverse to the longitudinal axis of the spray manifold 18.

In other words, the wheel supports 38*b* and 39*b* are adjustable in directions parallel to the longitudinal axis of the spray manifold 18 in order to support various different lengths of printing cylinders 14 but adjustability of the wheel supports 39*a* and 39*b* in a direction transverse to the longitudinal axis of the spray manifold 18 is utilized in order to support different diameters of printing cylinders 14.

As a result, the wheel supports 39*a* and 39*b* are adjustable in a direction parallel to the longitudinal axis of the spray manifold 18 as well as in a direction transverse to the longitudinal axis of the spray manifold 18 to support the idler set of wheels 22 in any of a plurality of adjustable positions such as 42, 44 and 46 so that the apparatus 10 is capable of cleaning printing cylinder such as 14' 14" and 14"' of differing diameters.

As for details of the wheel supports 38 and 39 and adjustable securing means which are associated with the sets of wheels 20 and 22, these are all well within the ability of one of ordinary skill in the art and need not be set forth in detail herein.

Referring to FIGS. 2 and 4, the apparatus 10 will be understood to include means for driving at least one of the wheels such as 20*a* to rotate the printing cylinder 14 within the cleaning solution 16 in the tank 12. This driving means may advantageously comprise a motor generally designated 48 which drives a shaft 50 having a sprocket 52 on the end thereof at a point within the tank 12 which drives a corresponding sprocket 54 through a chain or belt 56 where the sprocket 54 which may be operatively interconnected to the driven wheel 20*a* through a shaft or the like. As will be appreciated, the driven wheel 20*a* is rotated to thereby impart frictional driven rotation to the printing cylinder 14, which is permitted by reason of free rotational movement of the other wheels 20*b*, 22*a* and 22*b*.

As shown in FIG. 1, the apparatus 10 will be understood to suitably include a control panel generally designated 58. This control panel can be designed and equipped in such a manner as to control operation of the heater 26, the heater 27, the pump 30, and the motor 48. Clearly, the details of the control panel 58 can be varied as desired by those skilled in the art and need not be described herein.

Typically, the control panel 58 will be operable to cause the heater 26 to heat the cleaning solution 16 in the storage reservoir 24 through the heating element 26*a* before the cleaning solution 16 is delivered to the tank 12 by the pump 30. The sequence of heating, and then pumping, can be controlled in any number of ways, including a thermostatic control which measures the temperature of the cleaning solution 16 in the storage reservoir 24 and energizes the pump 30 once the cleaning solution 16 has reached the desired temperature. In any event, once the cleaning solution 16 is heated, it will be pumped into the tank 12 until it reaches a level such as shown in FIG. 1 where there is an amount sufficient to substantially immerse the printing cylinder 14 in the cleaning solution 16.

As will also be appreciated, the heater 27 will suitably maintain the cleaning solution 16 at a desired temperature within the tank 12 for the period of time while it is being sprayed onto the printing cylinder 14.

If desired, the pump 30 can fill the tank 12 with the cleaning solution 16 by delivering the cleaning solution 16 to the tank 12 directly through the spray nozzles 36. Alternatively, the pump 30 may simply deliver the cleaning solution 16 to the tank 12 through a suitable separate pipe (not shown) that is in direct communication with the tank 12. In any event, the pump 30 or another pump will spray the cleaning solution 16 under high pressure onto the surface 14*a* of the printing cylinder 14 after it substantial immersion as shown in FIG. 1.

For this purpose, the pump 30 or another pump will include suitable valves and/or pipes to draw the cleaning solution 16 from the storage reservoir 24 and deliver it under high pressure through the spray manifold 18 to the spray nozzles 36 following substantial immersion of the printing cylinder 14, all of which is within the ability of one skilled in the art. As the surface 14*a* of the printing cylinder 14 is being sprayed through the nozzles 36 of the spray manifold 18, the sets of wheels 20 and 22 are causing and allowing the printing cylinder 14 to rotate. Again, the control panel 58 can be such as to fully automate all of these steps in the desired sequence through suitable sensors and/or timing devices or, alternatively, the control panel 58 can include switches whereby each of the steps can be actuated by an operator. As will be appreciated, the sets of wheels 20*a*, 20*b* and 22*a*, 22*b* cause and allow the printing cylinder 14 to rotate by reason of the operation of the motor 48 which drives the driven roller 20*a* through the sprocket 52, the chain 56, the sprocket 54 and the shaft which serves to operatively interconnect the sprocket 54 and the wheel 20*a* to impart rotational movement thereto.

As will now be fully appreciated, the control panel 58 will contain suitable controls to maintain temperature, trigger the cleaning cycle, activate and deactivate the pump or pumps, and rotate the printing cylinder to expose the printing surface to the spray manifold 18. After the cleaning cycle, the cleaning solution 16 is drained from the tank 12 to the storage reservoir 24 which is suitably accomplished by means of a bi-directional drain 34 which includes a first outlet 34*a* for draining the cleaning solution 16 to the storage reservoir 24 and a second outlet 34*b* for a purpose which will be described in some detail hereinafter. After the cleaning solution 16 has been drained from the tank 12 to the storage reservoir 24, the bi-directional drain 34 may be set so as to close the first outlet 34*a* and open the second outlet 34*b* at which point the printing cylinder 14 may be subjected to a clean rinse with a rinsing solution.

As for the rinsing solution, it may typically comprise tap water or any other suitable rinsing solution depending upon the application. However, whatever the rinsing solution, it call be drained through the bi-directional drain 34 and the second outlet 34*b* from which it may be suitably directed for appropriate recycling or disposal. During the rinsing operation, the sets of wheels 20 and 22 will rotate and cause rotation of the printing cylinder 14 throughout the rinse cycle.

While not specifically discussed hereinabove, the filter 28 may be positioned at any point in the cycling of the cleaning solution 16 from the storage reservoir 24 to the tank 12 and then back into the storage reservoir 24. The filter 28 may, thus, be interposed in the path from the bi-directional drain 34 through the first outlet 34*a* back into the storage reservoir 24 or, alternatively, it may be upstream or downstream of the high pressure pump 30, i.e., between the storage reservoir 24 and pump 30 or between the pump 30 and the tank 12. Once again, and as will be appreciated, the selected placement of the filter 28 within the cleaning solution cycle is a matter that is well within the ability of those who are skilled in the art.

In practice, the cleaning solution 16 may advantageously comprise a blend of a product sold tinder the trademark "AQUATENE GM2000" by Graymills Corporation and an organic, aprotic, amine solvent (N-methyl-2-pyrrolidone). The chemical solution, particularly when heated to approximately 150° F.–155° F., and the apparatus 10, combine to provide an automated process in the form of a cleaning cycle that removes dried inks from anilox rolls, gravure cylinders, and other rolls used in flexographic and rotogravure printing processes (which are herein collectively and inclusively referred to as "printing cylinders"). In this connection, the cleaning cycle uses a technique that may suitably be referred to as "spray-under-immersion" to clean the surface, including the tiny cells of all such printing cylinders.

"Spray-under-immersion" has been found to prevent the cleaning solution from excessive foaming and misting with the step of first immersing the printing cylinder in heated cleaning solution, allowing the cylinder to come to temperature quickly and at an even rate. It has been found in practice that the heat assists in softening the ink and enhancing the wetting property of the cleaning solution. Still additionally, the immersion bath exposes all of the surfaces of the printing cylinder to the cleaning solution and thereafter floats the ink particles away after they have been removed from the surfaces of the printing cylinder by the spray.

As will now be appreciated, a complete cleaning cycle consists of (a) soak time, i.e., immersion of the printing cylinder in cleaning solution in the tank; (b) spray cycle, i.e., spraying the surface of the printing cylinder following immersion to remove ink; and (c) rinse cycle, i.e., draining the cleaning solution to the storage reservoir and rinsing the printing cylinder with rinse solution to remove residue; if desired, it is also possible to combine the cycle steps consisting of soak time and spray cycle in order to provide a single cleaning cycle.

While in the foregoing there has been set forth a preferred embodiment of the invention, it will be appreciated that the details herein given may be varied by those skilled in the art without departing from the true spirit and scope of the appended claims.

What is claimed is:

1. An automated apparatus for cleaning a printing cylinder, comprising:

a tank for receiving a printing cylinder that is to be cleaned of dried ink on a surface thereof;

a cleaning solution for said tank sufficient to substantially immerse said printing cylinder;

means for spraying said surface of said printing cylinder with said cleaning solution in said tank; and means for rotating said printing cylinder as said spraying means is spraying said surface thereof;

said rotating means including two sets of wheels within said tank wherein at least one of said wheels of one of said two sets is a driven wheel and the wheels of the other of said two sets are idler wheels adjustably positioned relative to said set of wheels including said driven wheel;

said spraying means including a longitudinally extending spray manifold mounted within said tank longitudinally adjacent said set of wheels including said driven wheel and having a plurality of spray nozzles each directing a spray of said cleaning solution onto said surface of said printing cylinder.

2. The automated apparatus of claim 1 including means for storing said cleaning solution.

3. The automated apparatus of claim 1 including means for heating said cleaning solution.

4. The automated apparatus of claim 1 including means for filtering said cleaning solution.

5. The automated apparatus of claim 1 including means for recycling said cleaning solution.

6. An automated apparatus for cleaning a printing cylinder, comprising:

a tank for receiving a printing cylinder that is to be cleaned of a dried ink on a surface thereof;

a cleaning solution for said tank sufficient to substantially immerse said printing cylinder;

means for spraying said surface of said printing cylinder with said cleaning solution in said tank;

means for rotating said printing cylinder as said spraying means is spraying said surface thereof; and means for recycling said cleaning solution including a storage reservoir, a heater, a filter, and a pump; and said rotating means including two sets of wheels within said tank wherein at least one of said wheels of one of said two sets is a driven wheel and the wheels of the other of said two sets are idler wheels adjustably positioned relative to said set of wheels including said driven wheel;

said spraying means including a longitudinally extending spray manifold mounted within said tank longitudinally adjacent said set of wheels including said driven wheel and having a plurality of spray nozzles each directing a spray of said cleaning solution onto said surface of said printing cylinder.

7. The automated apparatus of claim 6 wherein said heater is disposed in said storage reservoir for heating said cleaning solution therewithin and wherein said pump delivers said cleaning solution from said storage reservoir to said tank after said cleaning solution has been heated.

8. The automated apparatus of claim 6 including drain means for returning said cleaning solution to said storage reservoir from said tank and means for rinsing said printing cylinder after said cleaning solution has been returned to said storage reservoir from said tank.

9. An automated apparatus for cleaning a printing cylinder, comprising:

a tank for receiving a printing cylinder that is to be cleaned of a dried ink on a surface thereof;

a cleaning solution for said tank sufficient to substantially immerse said printing cylinder;

means for spraying said surface of said printing cylinder with said cleaning solution in said tank;

means for rotating said printing cylinder as said spraying means is spraying said surface thereof;

means for recycling said cleaning solution to said storage reservoir from said tank after cleaning;

means for rinsing said printing cylinder to remove residue of said cleaning solution from said surface thereof; and said rinsing means being operable after said cleaning solution has been drained to said storage reservoir; and said rotating means including two sets of wheels within said tank wherein at least one of said wheels of one of said two sets is a driven wheel and the wheels of the other of said two sets are idler wheels adjustably positioned relative to said set of wheels including said driven wheel;

said spraying means including a longitudinally extending spray manifold mounted within said tank longitudinally adjacent said set of wheels including said driven wheel and having a plurality of spray nozzles each directing a spray of said cleaning solution onto said surface of said printing cylinder.

10. The automated apparatus of claim 9 wherein said recycling means includes a heater disposed in said storage reservoir for heating said cleaning solution therewithin and a heater disposed in said tank for maintaining said cleaning solution at a desired temperature and wherein said pump delivers said cleaning solution from said storage reservoir to said tank after said cleaning solution has been heated.

* * * * *

UNITED STATES PATENT AND TRADEMARK OFFICE

CERTIFICATE OF CORRECTION

PATENT NO. : 5,490,460

DATED : February 13, 1996

INVENTOR(S) : SOBLE et al.

It is certified that error appears in the above-identified patent and that said Letters Patent is hereby corrected as shown below:

column 1, line 10, replace "frown" with --from--;

column 5, line 55, replace "call" with --can--; and column 6, line 8, replace "tinder" with --under--.

Signed and Sealed this

Sixteenth Day of July, 1996

*Attest:*

Bruce Lehman

BRUCE LEHMAN

*Attesting Officer*

*Commissioner of Patents and Trademarks*